United States Patent [19]

Vilargunte

[11] 4,413,658

[45] Nov. 8, 1983

[54] WARP AND WEFT WEAVING MACHINE

[76] Inventor: Valentin S. Vilargunte, Paseo Ramon Vall, 49-51, Navas, Spain

[21] Appl. No.: 295,330

[22] Filed: Aug. 24, 1981

[30] Foreign Application Priority Data

Aug. 25, 1980 [ES] Spain ..... 494.902

[51] Int. Cl.[3] ..... D03D 47/26; D03D 37/00; D03D 47/24

[52] U.S. Cl. ..... 139/436; 139/13 R; 139/224 R; 139/437

[58] Field of Search ..... 139/13 R, 13 A, 436, 139/224 R, 196.3, 437, 450, 452

[56] References Cited

U.S. PATENT DOCUMENTS

| | | | |
|---|---|---|---|
| 1,787,491 | 1/1931 | Primavesi | 139/13 R |
| 3,237,654 | 3/1966 | Hentz et al. | 139/224 R |
| 3,961,648 | 6/1976 | Turll | 139/13 R |
| 3,976,105 | 8/1976 | Steiner | 139/436 |

FOREIGN PATENT DOCUMENTS

| | | | |
|---|---|---|---|
| 82437 | 6/1971 | German Democratic Rep. | 139/196.3 |
| 525308 | 8/1972 | Switzerland | 139/436 |

*Primary Examiner*—James Kee Chi
*Attorney, Agent, or Firm*—Steinberg & Raskin

[57] ABSTRACT

A weaving machine has a continuous line of heddles 9 defining a shed and undulating means 8 for traversing the shed along the line as a wave 12, 13 and moving a weft-inserting means 15 in synchronism therewith from the inlet 17 to the outlet 18 ends of the line. The inserting means 15 are traversed from the outlet to the inlet ends by means (e.g. a driven chain 26) which carries them through loading stations 25 where they receive sufficient thread for one weft pass.

13 Claims, 18 Drawing Figures

FIG. 5
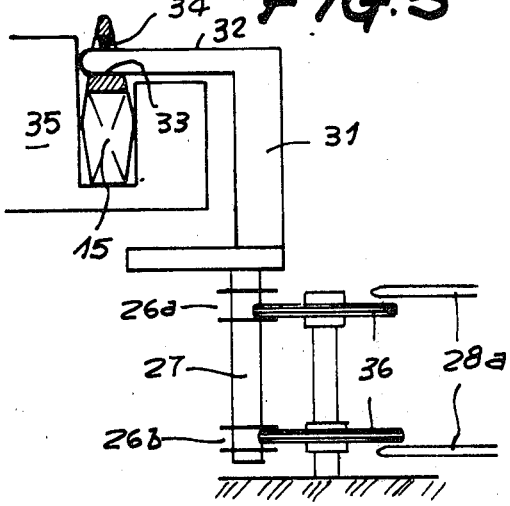
FIG. 6
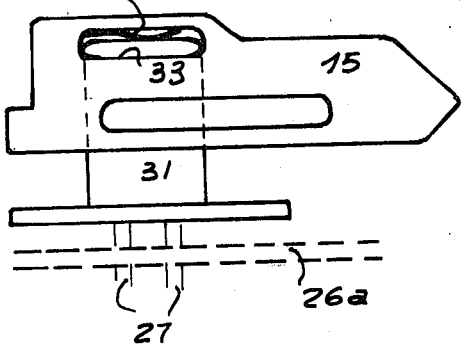
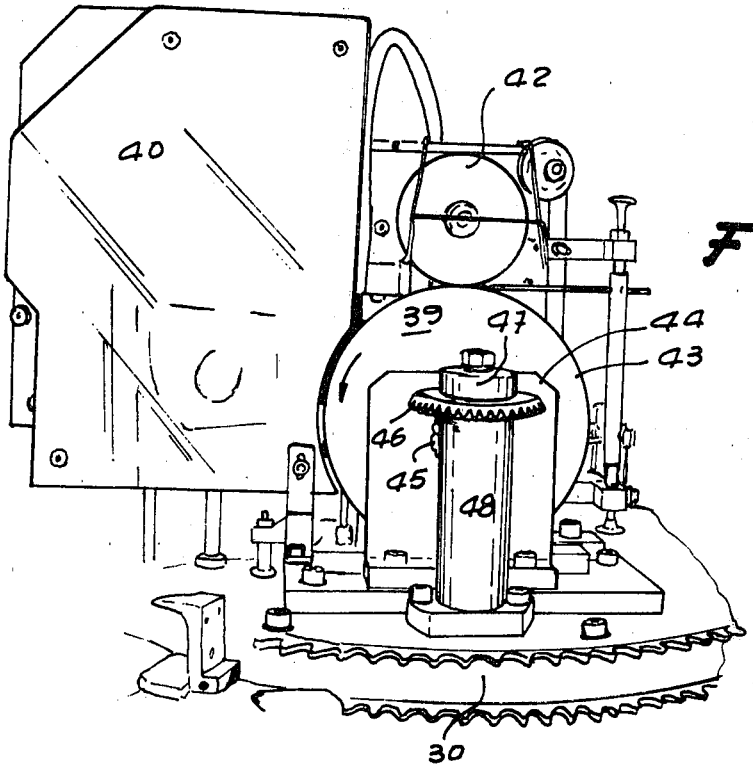
FIG. 7

WARP AND WEFT WEAVING MACHINE

BACKGROUND OF THE INVENTION

The present invention relates to warp and weft weaving machines.

A known type of warp and weft weaving machine comprises a means for providing a warp of parallel threads, a means for holding the formed woven fabric and, between these two means, at least one continuous row of heddles, actuated in turn from one end of the row to the other to form a continuous shed which moves between said two ends; this type of machine also incorporates a continuous row of drive plates for the weft-inserting means, which plates are adapted to form, across the shed, a supporting guide for an inserting means, and at least one undulating unit for moving the latter across the continuous shed in synchronism therewith so as to tension the weft threads, which are connected to the warp threads by inversion of the relative positions of the tenters of the shed, the rows of heddles and drive plates being arranged in a straight line or in a closed circle.

Machines of this kind naturally require special means for inserting the weft, these being different from the conventional shuttles, as well as elements for actuating the shuttles and providing them with an adequate supply of thread. The results obtained in the many tests carried out in this connection have not been totally satisfactory from all points of view, so that a wide field still remains open for developing this type of machine.

SUMMARY OF THE INVENTION

According to the present invention there is provided:

a warp and weft weaving machine which comprises: a means for providing a warp of parallel threads; a means for holding the formed woven fabric; and at least one continuous row of heddles disposed between these two means and actuable in turn from an inlet end of the row to an outlet end thereof to form a continuous shed which moves between said two ends; weft-inserting means; a continuous row of drive plates, which plates are adapted to form, across the shed, a supporting guide for the weft-inserting means; at least one undulating unit for moving the weft-inserting means across the continuous shed in synchronism therewith from inlet end to outlet end so as to tension the weft threads, which are connected to the warp threads by inversion of the relative positions of the tenters forming the shed; at least one inserting-means loading station adapted to load onto each said inserting means a measured length of weft thread corresponding to the consumption of thread for forming a weft pass; and means for moving the weft-inserting means between the outlet end of the shed and its inlet end, said means extending along a path in which is located said at least one loading station.

In a preferred embodiment, said means for moving the inserting means from said outlet end to said inlet end comprises an endless chain of articulated links which is driven by toothed wheels so that it has a forward run between the outlet and inlet ends of the continuous shed, and a return run between the inlet and outlet ends of the shed, which chain has a plurality of supporting teeth for the inserting means, which teeth project laterally from the chain and are adapted to engage, in a stable manner, in a complementary lateral opening provided in the inserting means, the outlet end and the inlet end of the shed being aligned respectively with seats for the introduction and extraction of the inserting means, in the first of which, each inserting means is deposited by the drive plates until a supporting tooth of the chain engages it, whereas the second receives the incoming inserting means and separates it from said chain, there being provided a drive means which drives this inserting means entering the shed immediately prior to the actuation of the first drive plates which form the drive wave.

Advantageously, each said inserting-means loading station is displaced, during each loading cycle, in synchronism with the advance of the chain and is coincidence with one of the supporting teeth of the chain, and is actuated by the load through means synchronized with said advance of the chain, in such manner that loading takes place within this period of coincidence.

The means for introducing the weft thread into the inserting means may comprise: a fork member displaceable between a non-operative position, in which it is disengaged from the chain, and a loading position in which its outlet end engages in the thread-passage opening of an inserting means in the loading position; devices for supplying compressed air and weft thread to said mouthpiece in such a way that the thread is drawn along by the stream of air to the outlet end of the mouthpiece; means for cutting the thread to a measured length and for retaining the remaining end; and actuating means for applying the outlet end of the mouthpiece to the loading opening in the inserting device and for injecting the air stream during the time that the inserting means is aligned with the loading station, and for actuating the cutting means on completion of loading. The means for cutting the measured length of weft thread preferably comprise a knife-edge secured within the passage for the air and thread in the mouthpiece, and a movable knife in the form of a blade which moves across this passage and has an orifice coinciding therewith and provided with the movable knife-edge, the blade portion located to the rear of the latter, as viewed in the direction of cut, being provided with a plurality of orifices for the passage of air so as not to interrupt the thrust applied to the thread directed below the cutting means. If required, the loading station may comprise means for opening the device for nipping and tensioning the weft thread, this taking place at the same time as the application movement of the charging mouthpiece occurs.

A weft-measuring means, which can be used in the machine of the invention, comprises: a pair of rollers which are caused to rotate so as to pull along the thread that is to be loaded into the inserting means; a thread-guide for receiving the pulled thread and formed by a compressed-air mouthpiece for urging the thread towards the inlet of the charging mouthpiece; a thread-guide which supports the thread at the inlet side of the rollers and can be actuated between a position in which the thread is outside the rollers and a position in which it is entrained by them; and means for carrying the thread-guide to the position for pulling the thread along, during the operation of loading the thread. Also, a means can be provided for gathering the impelled thread, between the inlet of the charging mouthpiece and the outlet of the thread-guide mouthpiece, which gathering means can be formed by two plates which are spaced from each other and between which the thread builds up into folded layers.

The attached drawings illustrate an embodiment to which the scope of the invention is not limited, and show diagrammatically a preferred practical arrangement.

BRIEF DESCRIPTION OF THE DRAWINGS

In the said drawings,

FIG. 5 is a sectional view drawn approximately along the line V—V in the previous Figure at the moment when a supporting hook deposits a weft-inserting means on the insertion seat at the inlet end of the shed;

FIG. 6 is a side view of a weft-inserting means mounted on one of the supporting teeth of the chain;

FIG. 7 is a side view of a station for loading the weft-inserting means;

DESCRIPTION OF THE PREFERRED EMBODIMENT

Figure 1:
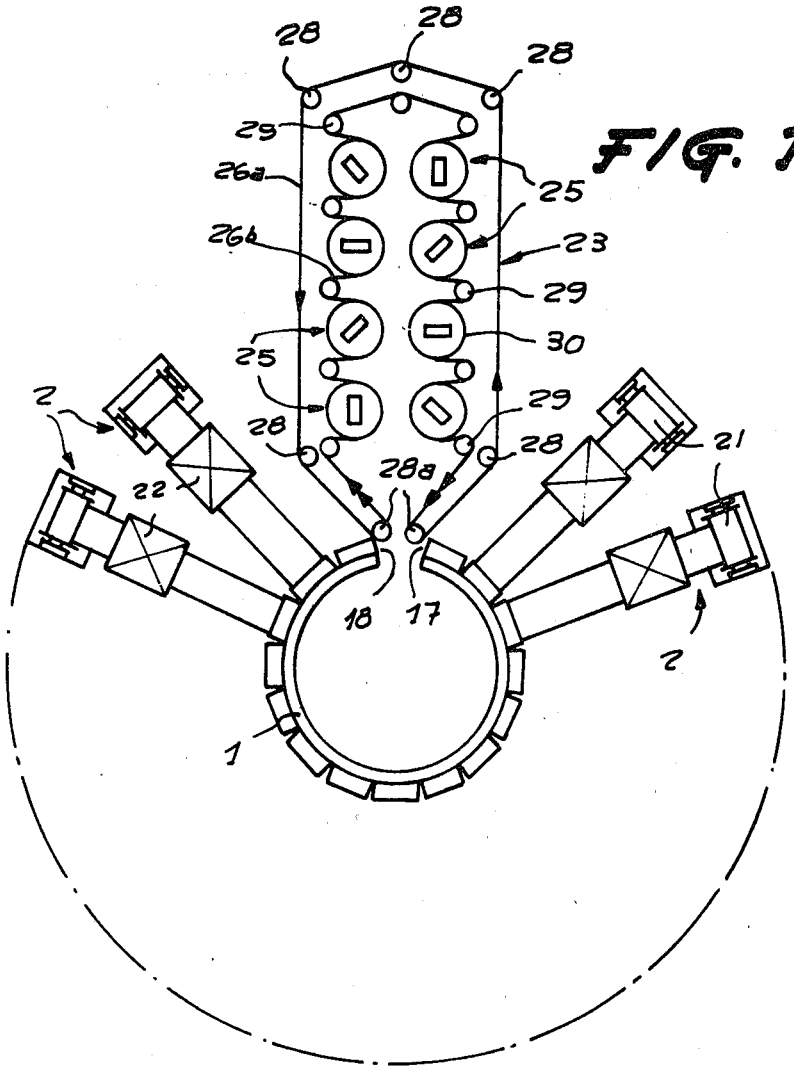
FIG. 1 is a plan view of the general layout of the machine in accordance with the invention.
Figure 2:
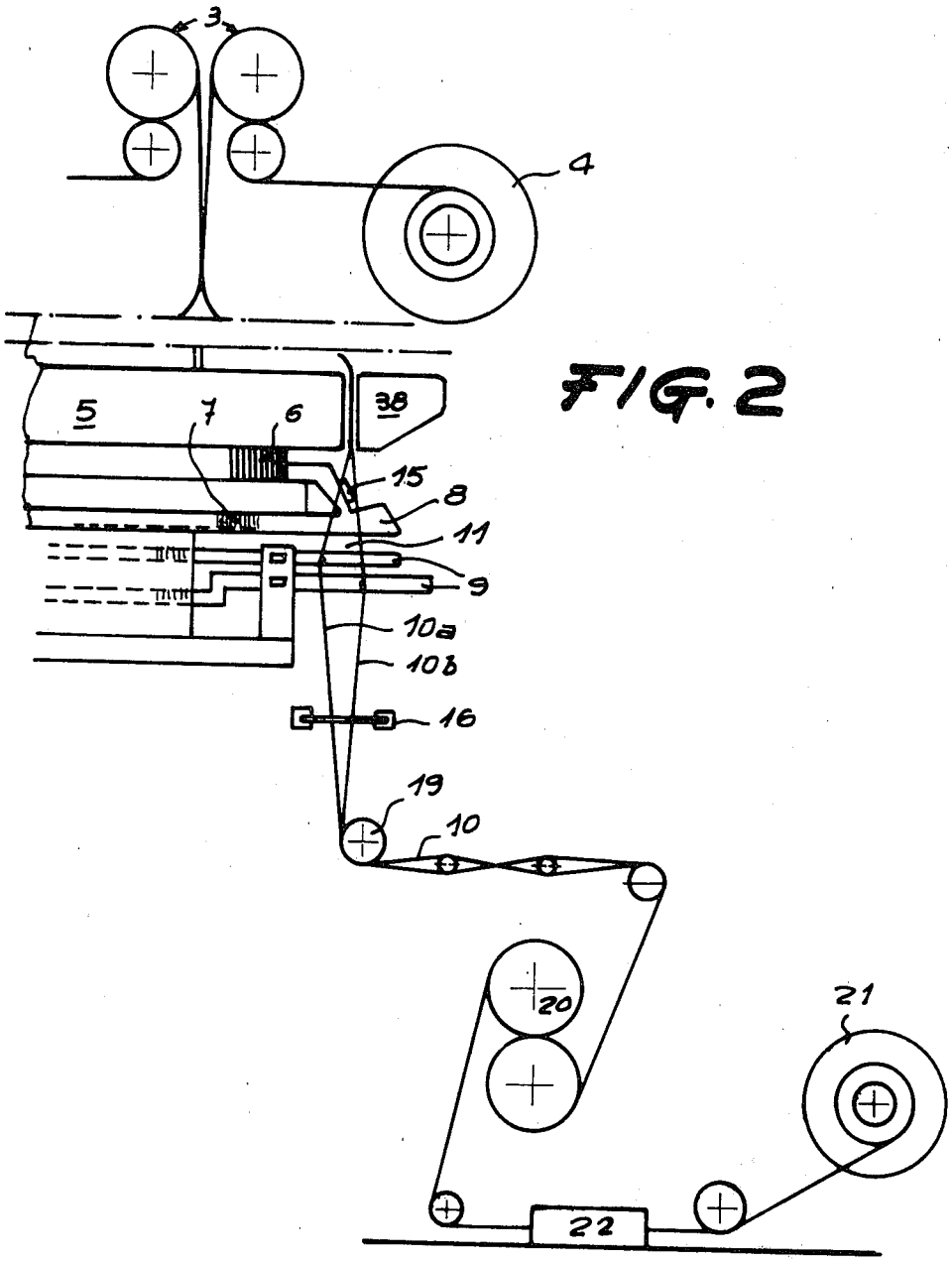
FIG. 2 provides an elevational view of one of the weaving units of the machine illustrated in FIG. 1.

FIG. 1 shows a circular continuous shed system 1 which is supplied over its entire contour by means of a series of warp-thread supply stations 2. As will be understood from FIG. 2, the warp threads are moved forward through the continuous shed system, and the formed woven fabric is received by collecting and folding units 3 and 4 respectively, located at the top of the machine assembly.

The continuous shed system is constructed in a manner similar to that of circular knitting machines which comprise radial needles and plates incorporating a hub or fixed body of revolution 5, provided with sets of radial grooves 6 and 7 which are located at different axial levels and in which sets of plates 8 and heddles 9 respectively are mounted to slide radially. The heddles are associated with the warp threads 10 in a manner similar to that used in shuttle looms, so as to separate, in the weaving zone, two groups of threads 10*a* and 10*b*, between which a shed 11 is defined, and for this purpose they are actuated, within the first body 5, by means of the cams of a rotating ring; these cams are not illustrated, but they can be easily imagined taking into account the fact that alternating movements are to be imparted to the two sets of heddles, as can be reduced from the undulations or waves 12 and 13 (FIG. 3), so as to invert the relative positions of the groups of threads 10*a* and 10*b* and to locate each heddle inserted betweem them. The plates 8, on the other hand, are actuated by cams within the body 5 to produce the undulations 14, in such manner that, between each two successive undulations, a seating is formed in which a weft-inserting means 15 is laterally supported by the group of warp threads 10*a* or 10*b* which at that moment is on the exterior and is driven by the undulation 13 which forms at its rear so as to cause it to advance over the length of the continuous shed. In the example illustrated, the direction of advance of the weft-inserting means is assumed to be in the clockwise direction in FIG. 1 and from right to left in FIG. 3.

Thus the shed is continuous in the sense that the warp threads, which pass through the guide comb 16, form a continuous circular wall which extends from the insertion end 17 (FIG. 3), passes completely round the machine (from right to left in FIG. 3) and arrives at the extraction end 18 (FIG. 1). Below the comb 16, the warp 10 passes over the return roller 19 and divides at the warp-supply stations 2, each of which comprises supply rollers 20. These warp-supply stations have been represented, for the sake of simplicity, by a warp folding unit 21 which differs from the conventional means only as regards the width of warp supplied, but in accordance with a further advantageous aspect of the invention, they can be expediently replaced by bobbin sections such as those used in the conventional warp steps in the weaving process. In this case, there can be provided, at the inlet to the machine, dressing means, likewise of a conventional type, indicated by blocks 22. The system for moving the weft-inserting means indicated generally by the reference numeral 23 is associated with the shed at the break in continuity which occurs at the insertion and extraction ends 17 and 18 respectively (FIG. 1). Insertion of the weft threads is achieved with the aid of a series of inserting means 15 (FIGS. 4 to 6) which are introduced at the end 17, one in each gap formed between two successive waves 12 and 13 of the thrust plates 8, these inserting means being provided with a quantity of thread corresponding to the development of the continuous shed between the two ends 17 and 18 i.e., over practically the entire contour of the machine; these means will be described in detail hereinafter. When the inserting means arrive at the extraction end 18, they leave the shed and pass through the means for moving them and traverse a series of weft-loading stations indicated generally by the reference numeral 25, wherein they receive a fresh supply of thread, after which they return to the insertion end 17 of the shed to start a fresh cycle.

In the example illustrated, the means for moving the inserting means is constituted by an endless chain arrangement, referred to hereinafter simply as "the chain 26" though it is in fact formed by two parallel superposed chains 26*a* and 26*b*, which are connected at intervals by studs 27 so that rigidity is imparted to the assembly in the longitudinal plane. The chain is driven by two rows of pairs of toothed wheels 28 and 29, the shafts of which are vertically disposed. Specifically, the wheels 28 move the chain 26 forming an outer run 26*a* which circulates in the direction of rotation described above from the end 17 to the end 18 of the continuous shed, and the two wheels 28*a* adjacent the said ends of the shed return the chain to form the other run 26*b*, which is within, and generally adjacent to, the first and is moved by the wheels 29 which engage, over an angle of approximately 180 degrees, with a number of rotating plates 30 which form the base of the loading stations 25 arranged in two longitudinal parallel lines.

The studs 27, arranged in pairs, carry a support 31 which extends forwardly and terminates in a tooth 32 projecting laterally beyond the closed outer run 26*a*. Each of these teeth is adapted to receive a weft-inserting device 15 by engaging in a transverse opening 33 formed in the inserting means, and this connection is achieved with the aid of a leaf spring 34 provided within said opening.

The movement of the inserting means, supported by the chain 26, towards and away from the shed 1 is achieved by the arrangement now to be described.

Figures 3, 4:
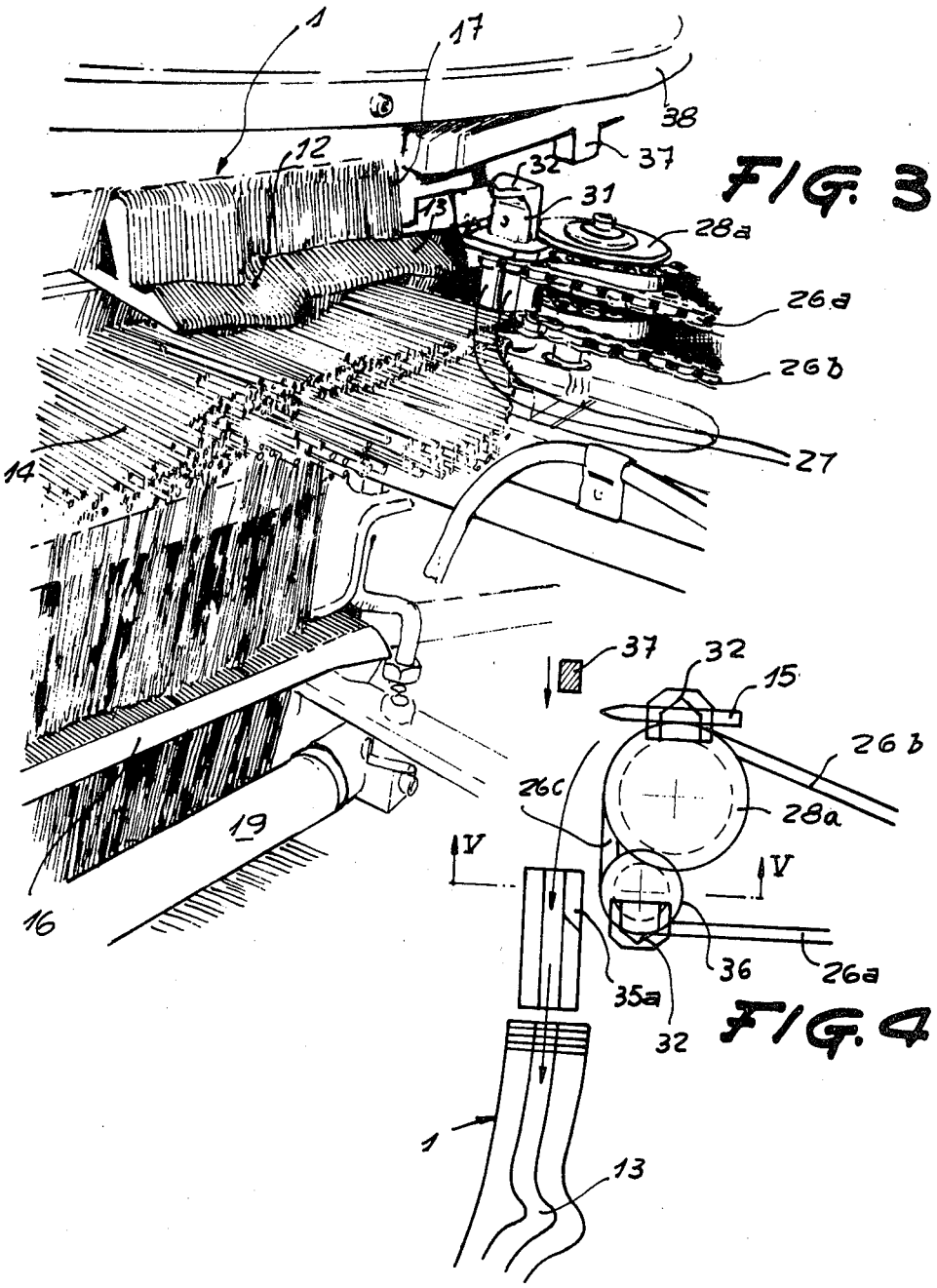
FIG. 3 is a perspective view of the weaving unit adjacent the inlet end of the shed.
FIG. 4 is a plan view of the FIG. 3 arrangement.

Located in front of the insertion end 17 of the continuous shed and secured to the body 5 is a cradle-like support 35 having a forwardly directed channel aligned with the passage formed by the drive plates in their retracted position towards the interior of the body 5 (FIGS. 3 and 4), said channel being adapted to receive an inserting means 15 which arrives in the direction indicated by the arrow in FIG. 4, having been moved by the inner chain 26*b* around the wheel 28*a*.

This entry is facilitated by the fact that this chain is moved, over a short run 26*c* approximately parallel with the continuous shed 1, by means of a small additional wheel 36 which is free to rotate on a shaft secured to the machine. A cut-away portion 35*a* at the inlet end of the cradle 35 facilitates outward movement of the supporting tooth 32 on rotation around the wheel 36. A similar arrangement, symmetrical in relation to the one described, can be used at the extraction end 18 for transferring the inserting means from the continuous shed to the chain. At the insertion end 17, a stop 37, secured to the ring 38 which rotates in synchronism with the cams generating the waves 12 to 14, pushes the inserting means 15, located in the cradle 35, until it is deposited in the guide passage, formed by the plates, just before the corresponding thrust wave 13 forms in front of said inserting means, which wave will have travelled over the entire perimeter of the shed to the extraction end 18.

Accordingly, the weft-inserting means that have passed their threads to the shed and arrive at the extraction end 18 are picked up by the teeth 32 of the chain and are moved, by the inner run 26*b* of the chain, through all the loading stations 25, in which they receive a fresh supply of thread and, once loaded, arrive at the insertion end where they again deliver the thread to the continuous shed. From this point, the empty chain travels along the outer run 26*a* and again moves towards the end for extracting the inserting means 18 and to pick up fresh inserting means for loading.

The continuous shed arrangement enables practically all of the inserting means to operate simultaneously within it, these inserting means arriving in turn with each of the thrust waves 12 and 13. Accordingly, the supporting teeth 32 of the chain are very closely spaced, generally to the extent of a central angular fraction of the plates 30. In the example illustrated, eight loading stations are provided so that the distance between two teeth of the chain is equal to an eighth of the periphery of each plate 30, and they are positioned relatively to the chain in such a way that a particular tooth is located in the angular position necessary for effecting loading in one only of the stations, i.e. each eight successive inserting means are loaded in, for example, successive loading stations as viewed in the direction of movement of the inner strand 26*a* of the drive chain.

Obviously, the machine comprises drive means which may be conventional and which are not illustrated but can be readily envisaged, these means actuating at least one of the wheels 28 and/or 29 driving the chain 26 in synchronism with the mechanisms which actuate the cams for forming the thrust waves 12 and 13 and which impart movement to the heddles which results in the formation of the fabric.

In each of the weft loading stations, the plate 30 can rotate freely about a vertical shaft secured to the machine, and on its upper face are mounted a device 39 (FIG. 7) for measuring the length of weft thread, a means 40 for gathering in the measured weft thread, a loading means 41 (FIG. 10) which loads the measured length of thread into a weft-inserting means located in the loading position, and means necessary for imparting a suitable functional sequence to these various units.

Figure 8:
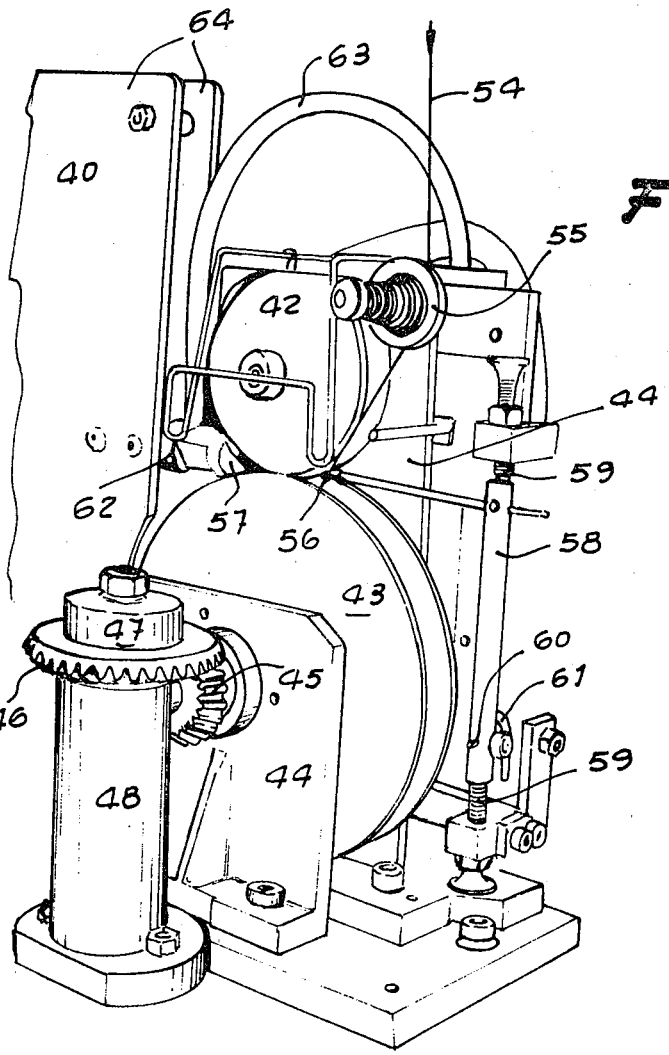
FIG. 8 shows, in a perspective view, the means for measuring lengths of weft thread.
Figure 18:
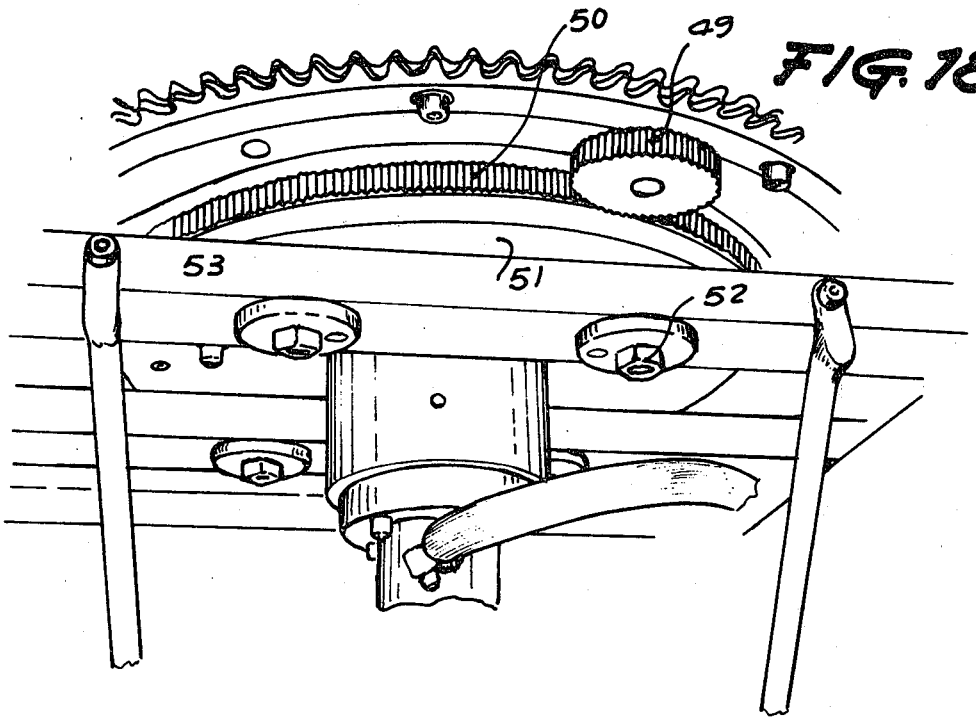
FIG. 18 is an underneath perspective view of a loading station.

As shown in FIGS. 7 and 8, the device for measuring the length of the weft thread comprises two driving rollers 42 and 43 mounted to rotate freely on a common support 44 secured to the plate 30; the shaft of the lower roller 43 is connected through a pair of pinions 45 and 46, set at an angle to each other, to a vertical shaft 47 rotating in a support 48 secured to the plate, which shaft extends below the plate (FIG. 18) where it is connected by means of a pinion 49 to the toothed ring 50 of a plate 51 which is secured by means of pins 52 to structural members 53 of the machine and is coaxial with the axis of rotation of the plate. Thus, rotation of the plate 30 causes the pinion 49 to roll along the ring 50 so that there is imparted to it a rotational movement about its own axis, which movement is transferred by the pinions 45 and 60 to the roller 43 so that the latter rotates in the anti-clockwise direction as shown in FIG. 7.

The weft thread 54, passing from a conventional supply unit located at the top of the FIGS. 7 and 8 arrangements, passes through tensioning discs 55 and through two thread-guides 56 and 57 which move it through the gap between the two rollers so that it is moved forward by the rollers while the other elements of the machine are operating. The thread-guide 56 is formed by an arm secured to a vertical shaft 58 which can rotate freely in pivots 59 secured to the support 44. The shaft 58 is actuated through suitable transmission means which comprise the arm 60 and the spindle 61, and with the aid of a cam, not illustrated, provided on the upper face of the fixed plate 51, so that the thread-guide is displaced laterally between the positions shown in FIG. 9 at suitable moments, the interval between which determines the length of thread supplied in each supply cycle and is controlled by the cam.

Figure 9:
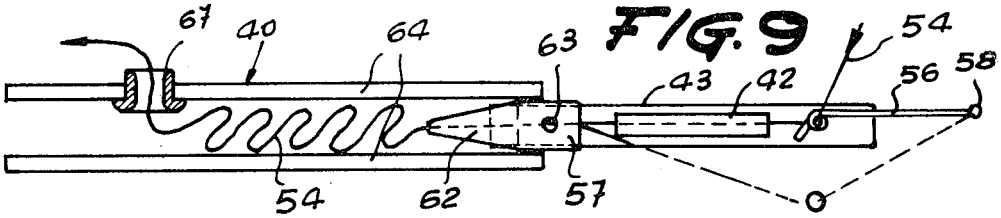
FIG. 9 is a plan view of the means illustrated in FIG. 8, and associated with the thread gathering unit of the invention.

The thread-guide 57 forms the thread inlet of a pneumatic pulse-imparting mouthpiece 62 which is supplied with compressed air through the pipe 63 so as to fling the thread, as shown in FIG. 9, between the two plates 64 where it is held by friction and electrostatic force, said plates thus forming a gathering unit 40.

Figure 10:
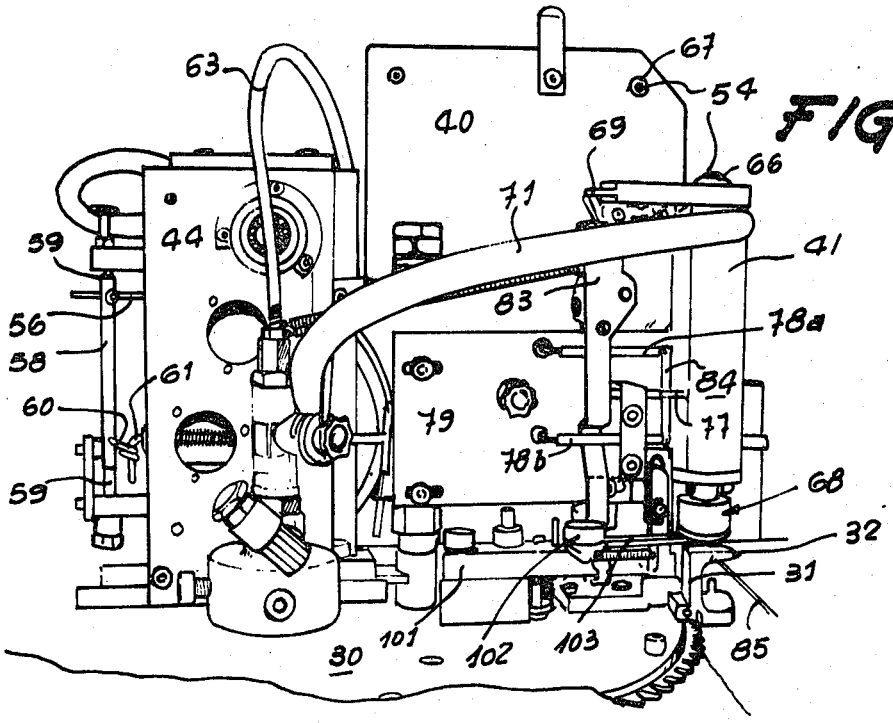
FIG. 10 is an elevational view of the loading station as seen from the side corresponding to the thread-loading mouthpiece.
Figure 11:
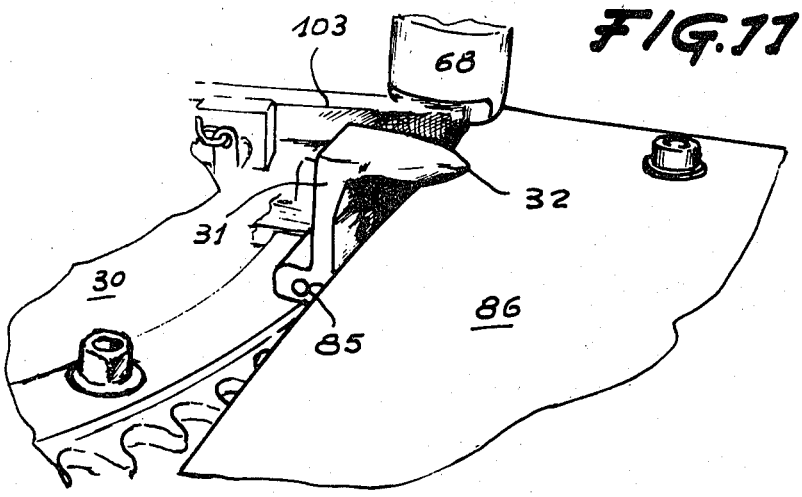
FIG. 11 shows, on a larger scale, a detail of the loading mouthpiece.
Figure 12:
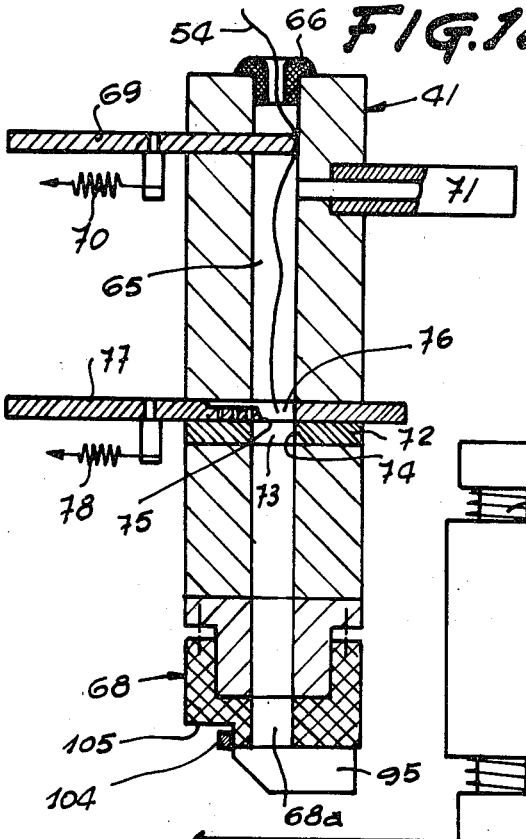
FIG. 12 is a sectional view along the axis of the loading mouthpiece.
Figure 13:
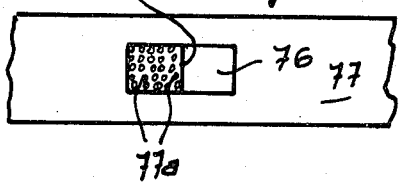
FIG. 13 is a top plan view of the knife for cutting the thread.
Figure 14:
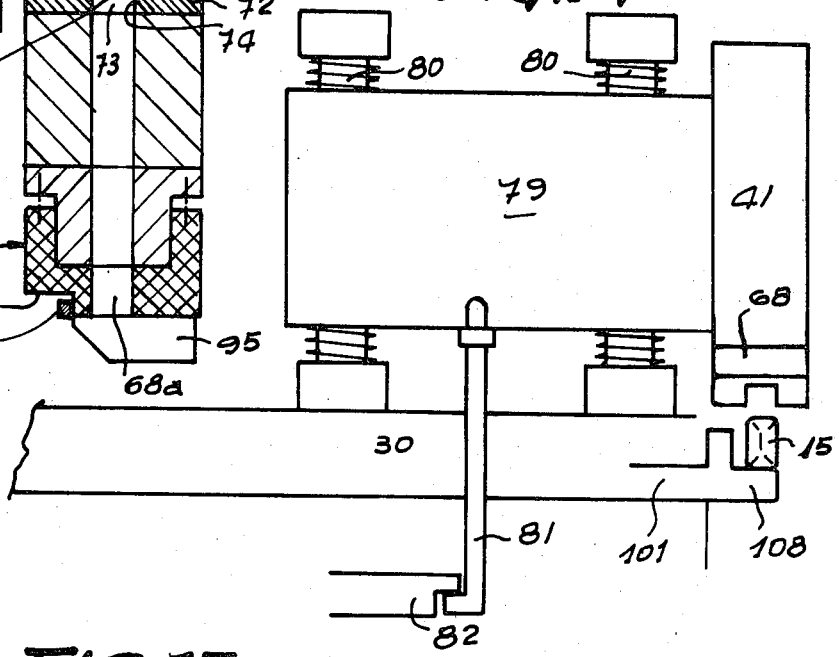
FIG. 14 shows one form of means for actuating the loading mouthpiece.
Figure 15:
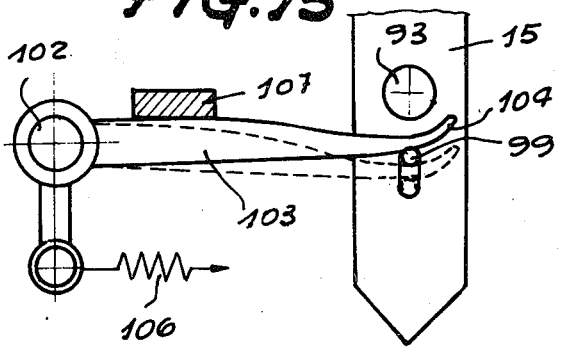
FIG. 15 shows, in plan view, a detail from FIG. 14.
Figure 16:
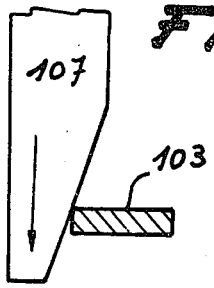
FIG. 16 is a section extending approximately along the line XVI—XVI of FIG. 15.

The thread stored in the unit 40 will be drawn in, at the moment of loading, by the mouthpiece 41 for loading the weft-inserting means 15 (FIGS. 10 to 16). As shown in FIGS. 12 and 13, loading means 41 is formed by a tubular body so arranged that its bore 65 is vertically disposed; its upper end carries a thread-guide 66 which receives the weft thread 54 emerging from the thread-guide 67 at the outlet of the gathering unit. The lower end of the tubular body forms a mouthpiece 68 which is for connecting to the thread-inserting means 15 and is provided with an orifice 68*a* for supplying weft thread to said inserting means. Near the inlet thread-guide 66, a shutter 69 extends across the loading means 41; this shutter is urged by a spring 70 in the direction indicated by the arrow and it can be moved into the illustrated position to nip the thread by means to be described later. Immediately below this shutter a pipe 71 connects with the bore of the tubular body, this pipe 71 supplying compressed air to the unit. Further down, the body 41 is traversed by a plate 72 having an orifice 73 which is coaxial with the bore 55 and the right-hand edge of which forms a fixed cutting edge 74 with which co-operates an edge 75 formed in an opening 76 provided in a strip 77 which can slide freely in the longitudinal direction in a complementary seating provided above the plate 72; this strip is also urged by a spring 78 and can be moved into the cutting position to sever the measured length of thread, by means which will be described later. As can be seen, the portion of the strip 77 adjacent the edge 75 is provided with a large number of small perforations 77*a* so as not to interrupt the flow of air for carrying along the thread, at the cutting position of the strip. As shown in FIGS. 10 and 14, the loading means 41 is secured to a support 79 which is slidable vertically on columns 80 secured to the plate 30. By means of a rod 81, the support is displaceable by a cam 82 positioned on the inside of the plate 51, so that the connecting mouthpiece 68 is normally held in a raised position so as to afford passage to the weft-inserting means 15 which takes up a loading position at the inlet and outlet ends of the plate 30; however, the mouthpiece may be applied to the inserting means so as to effect loading.

For the purpose of actuating the shutter 69 and the cutter strip 77, use is made of a lever 83 pivoted at its lower end (not visible in FIG. 10) on a shaft secured to the support 79, said lever being so arranged that during the downward movement of this support it encounters a stop secured to the upper surface of the plate 30, which stop causes it to swing to the right, as seen in the Figure, so that it urges the abovementioned slide and cutter in the same direction. In FIG. 10, the spring 78 has been replaced by two springs 78*a* and 78*b* which produce the same effect by being connected to the ends of a bridge element 84 in turn secured centrally to the cutting strip 77.

FIGS. 10 and 11 illustrate the elements in the loading position, but for the sake of clarity these figures omit the weft-inserting means 15 which, as previously described, will be mounted on a supporting tooth 32 in a position adjacent the edge 85 of the fixed covering sheet 86 which prevents lateral deflection of the weft-inserting means.

Figure 17:
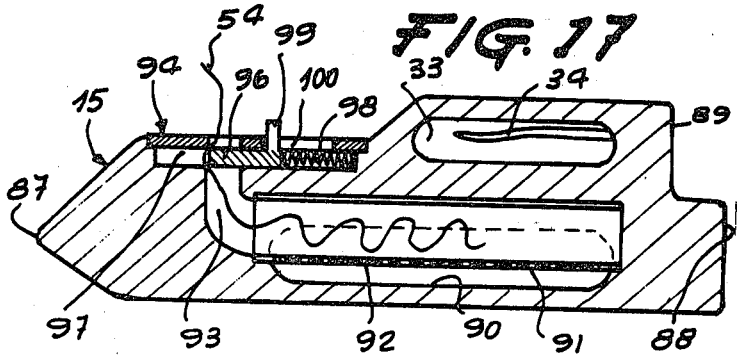
FIG. 17 is a diagrammatic section along the axis of a weft-inserting means.

FIG. 17 shows a diagrammatic longitudinal section through one of the weft-inserting means 15, in which Figure use is made of the reference numerals applied to some of the already described elements or parts. It will be seen that this inserting means has a pointed front end 87 so that it is not impeded during its travel through the shed; its rear end comprises a cam surface 88 complementary to the thrust surface formed on the stepped plates for setting up the driving wave 13. Said inserting means also has a surface 89 disposed at right angles to the main axis and adapted to engage the stop 37 for effecting introduction into the shed. In the lower portion of the body of the inserting means is a wide longitudinal opening 90 extending from one side to the other and within which is fitted a thin tube 91 having perforations 92 over its entire circumference. The forward end of the tube 91 communicates with a duct having an opening 93 at the planar upper face 94 of the body of the inserting means, so that in the loading position illustrated in FIGS. 10 and 11 a radially extending channel 95 provided in the connection 68 of the loading mouthpiece 41 can be adjusted relatively to the face 94 of the inserting means so that the orifice 68*a* of the mouthpiece of the loading means 41 is brought into register with the opening 93 of said inserting means.

Accordingly, the length of weft thread stored in the gathering unit 40 is drawn into the loading mouthpiece by the current of air which enters through the pipe 71 and the thread is urged towards the interior of the tube 91 from which air escapes by way of the perforations 92. For this purpose, the duct may be of such shape that it lies substantially tangentially in relation to said tube 91, so that the stream of air entering it has a certain rotational component which will tend to form the thread into a coil within said tube.

The opening 93 is traversed by a slide 96 moving within a seat 97, which slide is urged by a spring 98 which applies sufficient force to retain the weft thread and to apply thereto the braking action necessary for suitably tensioning the weft within the shed when insertion takes place. The loading station comprises means for preventing this slide from impeding the loading of the thread, and for this purpose said slide has an actuating pin 99 which projects beyond the inserting means through a slot 100, and the plate 30 carries a support 101 (FIGS. 10 and 11) provided with a vertical shaft 102 on which is pivoted a lever 103 the end of which is so shaped at 104 that it can be introduced into a recess 105 in the connecting mouthpiece 68 in front of the projecting end of the pin 99. The lever tends to remain in the position illustrated in FIG. 12 under the action of a spring 106, but when the support 79 for the loading means descends, it is urged in the opposite direction by a wedge 107 secured to said support, so that the pin 99 and the slide 96 are displaced to uncover the opening 93.

To facilitate these movements, there is provided, below the connecting mouthpiece 68, a small platform 108 which forms part of the support 101 and on which rests the weft-inserting means that has been loaded.

The mode of operation of the machine detailed above can be deduced from the foregoing description:

Each weft-inserting means 15 that moves to the outlet end 18 of the continuous shed is picked up by a supporting tooth 32 of the chain 26 and is moved by the inner run 26*b* of the chain across the loading stations wherein, in the meantime, the measuring device 39 prepares (in the gathering unit 40) the length of weft thread necessary for carrying out loading.

When the inserting means arrives at a station in which, by engagement of the chain with the plate 30, it coincides with the angular position of the loading means 41, the latter is applied to the inserting means. The stream of compressed air that arrives through the duct 71 draws the thread, stored in the gathering unit 40, towards the interior of the tube 91, and the knife 77 cuts the weft thread within the loading means, following which the latter rises and the loaded inserting means continues its travel across the remaining loading stations until it arrives at the insertion end 17, where it is introduced into the continuous shed to effect insertion.

An additional advantage of this machine resides in the fact that the loading stations can be supplied with weft thread by means of devices which make direct use of spun thread, made up into cops or other forms, without the need for their undergoing the intermediate preparatory operations that are necessary in the known weaving systems. Use could be made of, for example, motorized or variable-tension feed units which supply the weft threads at a predetermined rate or under a predetermined tension, the thread being drawn from cops mounted on a conventional bobbin with their ends interconnected so that the supply is continuous. A bobbin of this kind can be accommodated in, for example, the space available below the feed stations in the example described.

I claim:

1. A warp and weft weaving machine which comprises: means for providing a warp of parallel threads; means for holding the formed woven fabric; and at least one continuous row of heddles disposed between these two means and actuable in turn from an inlet end of the row to an outlet end thereof to form a continuous shed which moves between said two ends; weft-inserting means; a continuous row of drive plates, which plates are adapted to form, across the shed, a supporting guide for the weft-inserting means; at least one undulating unit for moving the weft-inserting means across the continuous shed in synchronism therewith from inlet end to outlet end so as to tension the weft threads, which are connected to the warp threads by inversion of the relative positions of tenters forming the shed; at least one inserting-means loading station adapted to load onto each said inserting means a measured length of weft thread corresponding to the consumption of thread for forming a weft pass; and means for moving the weft-inserting means between the outlet end of the shed and its inlet end, said means extending along a path in which is located said at least one loading station, said means for moving said weft-inserting means including means for positively supporting said weft-inserting means along said path between the outlet and inlet ends of the shed and for positively supporting said weft-inserting means as the latter are transferred from said outlet end of said shed to said moving means and from said moving means into said inlet end of said shed.

2. A weaving machine according to claim 1, wherein said means for moving the inserting means from said outlet end to said inlet end comprises an endless chain of articulated links which is driven by toothed wheels so that it has a forward run between the outlet and inlet ends of the continuous shed, and a return run between the inlet and outlet ends of the shed, which chain has a plurality of supporting teeth for the inserting means, which teeth project laterally from the chain and are adapted to engage and positively support said weft-inserting means, in a stable manner, in a complementary lateral opening provided in the inserting means, the outlet end and the inlet end of the shed being aligned respectively with seats for the introduction and extraction of the inserting means, in the first of which, each inserting means is deposited by the drive plates until a supporting tooth of the chain engages it so that said weft-inserting means are positively supported as the latter are transferred from said outlet end of said shed to said moving means, whereas the second receives the incoming inserting means and separates it from said teeth so that said weft-inserting means are positively supported as the latter are transferred from said moving means into said inlet end of said shed, there being provided a drive means which drives this inserting means entering the shed immediately prior to the actuation of the first drive plates which form the drive wave.

3. A weaving machine according to claim 2, wherein said at least one inserting-means loading station is displaced, during each loading cycle, in synchronism with the advance of the chain and in coincidence with one of the supporting teeth of the chain, and is actuated by the load through means synchronized with said advance of the chain, in such manner that loading takes place within this period of coincidence.

4. A weaving machine according to claim 3, wherein each loading station comprises: a rotating toothed plate, an angular portion of which meshes with the chain; first means for introducing the weft into its inserting means; and second means for measuring the required length of weft, which means is actuated during the loading periods so as to feed the first means.

5. A weaving machine according to claim 2 wherein each of the weft-inserting means comprises a wide body which is flattened in a longitudinal and generally vertical plane, in one of the ends of which body is formed the lateral opening for engagement with the supporting tooth of the chain, and in the opposite end of said body is formed an inlet window for the loaded thread, which window is provided with a nipping and tensioning unit for holding the end of the thread and communicates with a cylindrical cavity through a tangential passage, the cylindrical cavity being provided with a series of orifices which communicate with the exterior so that a stream of air, driving a measured length of thread, escapes through said orifices, when the thread, coiled within the cavity, emerges.

6. A weaving machine according to claim 5 wherein the means for introducing the weft thread into the inserting means comprises: a loading means defining a conduit, which loading means is displaceable between a non-operative position, in which it is disengaged from the chain, and a loading position in which its conduits outlet end engages in the thread-passage opening of an inserting means which is in the loading position; devices for supplying compressed air and weft thread to said conduit of the loading means in such a way that the thread is drawn along by the stream of air to the outlet end; means for cutting the thread to a measured length and for retaining the remaining end; and actuating means for applying said outlet end to the loading opening in the inserting device and for injecting the air stream during the time that the inserting means is aligned with the loading station, and for actuating the cutting means on completion of loading.

7. A weaving machine according to claim 6, wherein the means for cutting the measured length of weft thread comprises a knife-edge secured within said conduit, and a blade means movable across the conduit and having an orifice which can be brought into register therewith, the rear portion of the blade means being provided with a plurality of orifices for the passage of air so as not to interrupt the thrust applied to the thread directed below the cutting means.

8. A weaving machine according to claim 5 comprising means for opening the nipping and tensioning unit at the same time as the application movement of the charging mouthpiece occurs.

9. A weaving machine according to claim 6, wherein the weft-measuring means comprises: a pair of rollers which are arranged to rotate so as to pull along the thread that is to be loaded into the inserting means; a thread-guide for receiving the pulled thread and formed by a compressed-air mouthpiece for urging the thread towards the inlet of the loading means conduit; a thread-guide which supports the thread at the inlet side of the rollers and is actuable between a position in which the thread is outside the rollers and a position in which it is entrained by them; and means for carrying the thread-guide to the position for pulling the thread along, during the operation of loading the thread.

10. A weaving machine according to claim 9, comprising means for gathering the impelled thread between the inlet to said conduit and the outlet of the thread-guide mouthpiece.

11. A weaving machine according to claim 10, wherein the thread-gathering unit is formed by two spaced plates, between which the thread can be gathered in folds.

12. A weaving machine according to claim 1 wherein the rows of heddles and drive plates are arranged in substantially a straight line.

13. A weaving machine according to claim 1 wherein the rows of heddles and drive plates are arranged substantially in a circle.

* * * * *